US011536525B2

(12) United States Patent
Kusnierz

(10) Patent No.: US 11,536,525 B2
(45) Date of Patent: Dec. 27, 2022

(54) RECEIVER LATCH FOR A FIREARM

(71) Applicant: Smith & Wesson Inc., Springfield, MA (US)

(72) Inventor: Zachary Kusnierz, Westfield, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 17/684,532

(22) Filed: Mar. 2, 2022

(65) Prior Publication Data

US 2022/0282942 A1 Sep. 8, 2022

Related U.S. Application Data

(60) Provisional application No. 63/155,996, filed on Mar. 3, 2021.

(51) Int. Cl.
*F41A 3/66* (2006.01)

(52) U.S. Cl.
CPC ..... *F41A 3/66* (2013.01)

(58) Field of Classification Search
CPC ..... F41A 3/66
See application file for complete search history.

(56) References Cited

U.S. PATENT DOCUMENTS

| | | | |
|---|---|---|---|
| 7,966,762 | B2 | 6/2011 | Barrett |
| 8,261,479 | B2 | 9/2012 | Barrett |
| 8,925,234 | B1 | 6/2015 | Barrett |
| 9,188,399 | B1 | 11/2015 | Findlay et al. |
| 10,605,548 | B1 | 3/2020 | Lukofnak, III |

*Primary Examiner* — Reginald S Tillman, Jr.
(74) *Attorney, Agent, or Firm* — Ballard Spahr LLP

(57) ABSTRACT

A firearm having a fixed magazine uses a latch to secure upper and lower receivers to one another in a closed position. The upper and lower receivers can be pivoted relatively to one another into an open position providing access to the magazine for loading by rotating the latch to release the upper and lower receivers from one another. The latch includes a hook spring biasing a hook contact surface of the latch to engage a hook receiving surface of a receiver when the receivers are moved from the open position to the closed position.

20 Claims, 11 Drawing Sheets

RECEIVER LATCH FOR A FIREARM

CROSS REFERENCE TO RELATED APPLICATION

This application is based upon and claims benefit of priority to U.S. Provisional Application No. 63/155,996, filed Mar. 3, 2021 and hereby incorporated by reference herein.

FIELD OF INVENTION

This disclosure relates to firearms having receivers formed of upper and lower portions and mechanisms for releasably retaining the upper and lower receiver portions to one another.

BACKGROUND OF INVENTION

Rifles having fixed magazines, such as the Krag-Jorgensen, Mauser K98, Lee-Enfield and M1 "Garand" were the dominant rifle designs of the late $19^{th}$ and early to mid $20^{th}$ Centuries until they were supplanted by the now ubiquitous detachable magazine rifles whose design heritage can be traced back to the lesser known Sturmgewehr 44.

Although the detachable magazine rifle boasts numerous advantages, particularly for military applications, the fixed magazine rifle is still thought to be a design particularly suited to sportsmen for hunting, target, and recreational shooting. The integral nature of the fixed magazine design provides a reliable and complete shooting platform which only needs ammunition to function. There is clearly a place among modern sporting rifles for a fixed magazine design which combines the simplicity, reliability and light weight of modern rifles with the advantages of this $19^{th}$ century development.

Design challenges involving fixed magazine firearms center about providing convenient access to the fixed magazine for loading ammunition. There are advantages to be realized for designs which allow popular existing rifle platforms to be adapted to the fixed magazine configuration by allowing ready access to the magazine.

SUMMARY

This disclosure concerns a latch for releasably retaining an upper receiver of a firearm to a lower receiver thereof. The upper receiver and the lower receiver are rotatably engaged with each other by way of a pivot axis such that they rotatable between a closed position and an open position. In one example embodiment the latch is comprised of an axle rotatably mountable within one of the upper and lower receiver portions. A lever extends transversely from the shaft for manual rotation thereof. A hook having a body defining a contact surface is mounted on the axle and rotatable therewith. The hook is engagable with the other of the upper or lower receiver for retaining the upper and lower receivers together.

In a particular example, a hook receiving surface is formed on one of the upper or lower receivers in a position facing the hook. A hook spring is mounted to the axle to bias the body and its contact surface towards the hook receiving surface. When the upper and lower receivers are moved into the closed position, the hook spring biases the body such that the contact surface engages the hook receiving surface to secure the upper and lower receivers together. The lever may be rotated to overcome the biasing of the hook spring to disengage the contact surface and the hook receiving surface to allow the upper and lower receivers to be moved into the open position.

In another example, the axle includes a shaft, a first spring retention cylinder, a retaining nut, and a second spring retention cylinder. The first and second spring retention cylinders are positioned on either sides of the body. In this example, the hook spring is comprised of a first spring coil having a first pressure arm, a second spring coil having a second pressure arm, and a horizontal spacing arm connecting the first and second coils. The hook spring is mounted on the axle such that the first and second spring coils engage the first and second spring retention cylinders respectively. The first and second pressure arms engage the upper or lower receiver where the axle is installed and combine with the coils to exert a biasing force on the body. When the receivers are in the closed position, this biasing force moves the contact surface into engagement with the hook receiving surface.

In a specific example, the first and/or second spring retention cylinders may be bearing sleeves to facilitate a smooth rotation of the hook spring and the axle. In other specific example, the first and/or second spring retention cylinders may be formed as a fixed portion of the shaft and/or retaining nut respectively. This example reduces the complexity of the design for simplicity in manufacturing and assembly.

In another example, the shaft may include a partially-circumferential trough formed therein. A detent, mounted in the same one of the upper or lower receiver as the latch, engages the partially-circumferential trough to limit the biased rotating of the axle so that the contact surface of the body is positioned to engage the hook receiving surface when the upper and lower receivers and moved from the open position to the closed position. The detent additionally retains the shaft within the upper or lower receiver and prevents its removal while the detent is in position.

In one example, a cam is formed on the receiver opposite the receiver wherein the latch is mounted. A cam follower is formed on the body of the hook. When the upper and lower receivers are moved from the open position to the closed position, the cam engages the cam follower to rotate the hook against the hook spring bias until the contact surface is in position to engage the hook receiving surface. In one example, the cam can comprise a concave counter surface formed opposite the hook receiving surface and angled away from the hook receiving surface. The cam follower comprises a curved portion of the hook body. This configuration allows the cam to both engage the cam follower to move the hook as well as centering the body so when the contact surface engages the hook receiving surface it is properly aligned.

In another example, the body of the hook may include a protrusion. The protrusion is positioned on the body to stop the biased rotation of body in a location where the cam follower is held aligned with the cam when the upper and lower receivers are in the open position. This provides a smooth and reliable locking of the upper and lower receivers when they are moved from the open position to the closed position.

In one additional example, the protrusion may work in concert with the partially-circumferential trough to align the cam follower with the cam while the receivers are in the open position. This provides both a redundancy in alignment characteristics as well as a distribution of the forces encountered when the hook spring moves the body into proper position after release of the lever.

DETAILED DESCRIPTION

The present disclosure can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

Figure 1:
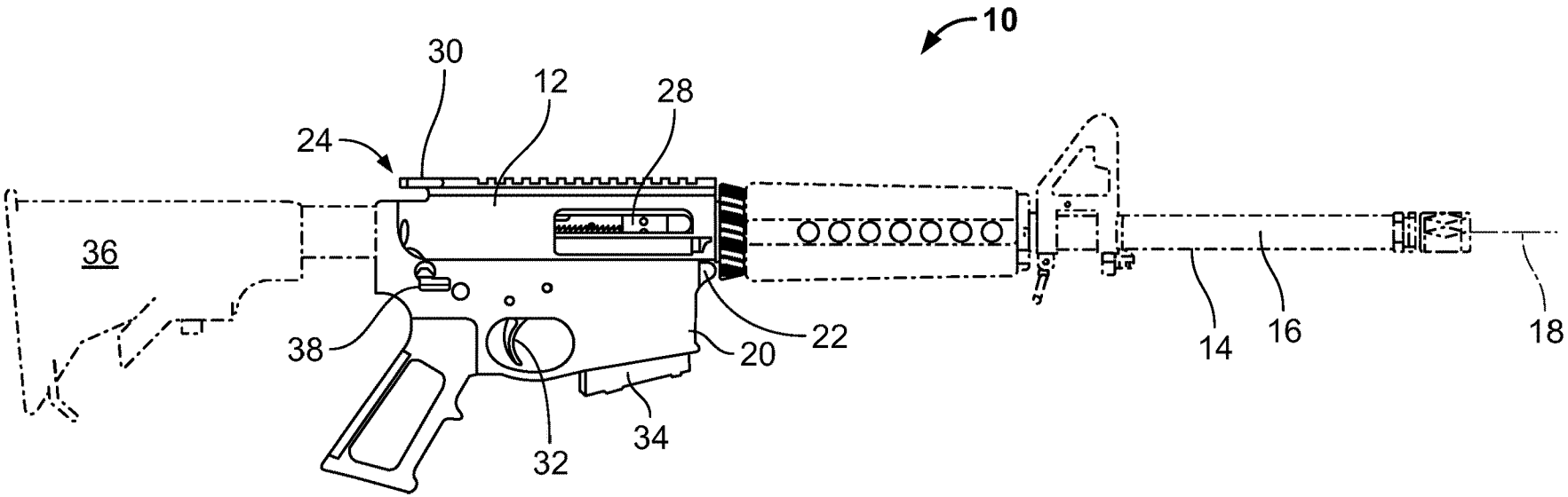
FIG. 1 is a side view of an example firearm according to the disclosure showing the upper and lower receivers in a closed position.
Figure 2:
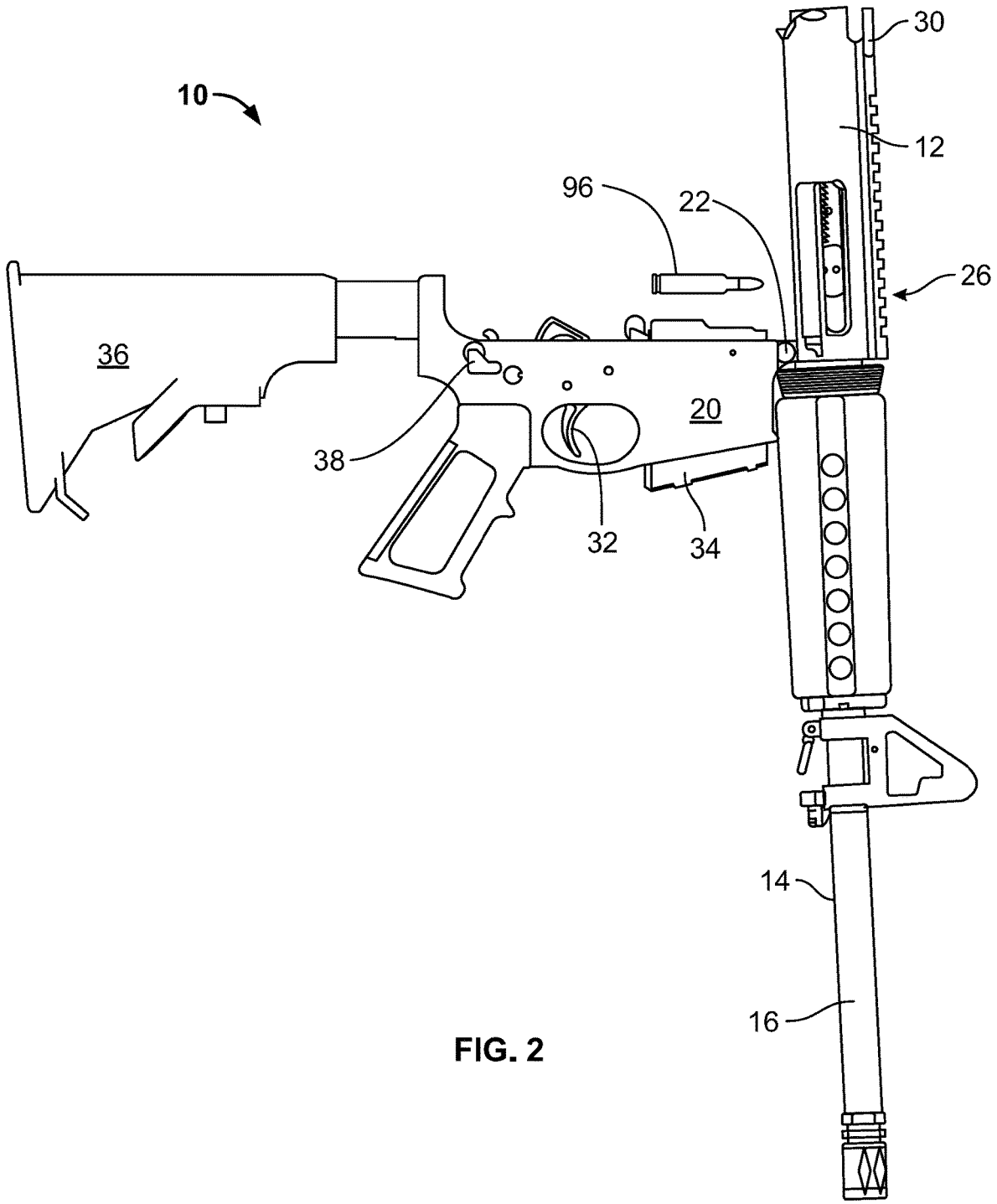
FIG. 2 is a side view of the firearm shown in FIG. 1 in with the upper and lower receivers in an open position.

FIGS. 1 and 2 show an example firearm 10 according to the disclosure, a modern sporting rifle being illustrated. Firearm 10 comprises an upper receiver 12. A barrel 14 is mounted on the upper receiver 12, the barrel having a bore 16 defining a firing axis 18 coaxially arranged therewith. A lower receiver 20 is attached to the upper receiver 12. As shown by a comparison between FIGS. 1 and 2, the lower and upper receivers 12 and 20 are pivotable relatively to one another about a pivot axis 22. The pivot axis 22 is oriented transversely to the firing axis 16. Pivoting motion of the receivers is between a closed position 24, shown in FIG. 1, and an open position 26, shown in FIG. 2. Pivot axis 22 may be conveniently defined by a pivot bearing, rotational shaft, or other feature which passes through lugs on the upper and lower receivers, as is understood and thus not shown in detail.

The firearm 10 may include a bolt carrier 28 and a charging handle 30 mounted on the upper receiver 12. The firearm 10 further can include a firing mechanism 32, a fixed magazine 34, and rifle stock 36 as part of the lower receiver 20. In the example shown, the pivot axis/pivot bearing 22 is positioned forward of the fixed magazine 34. When the upper receiver 12 is moved into the open position 26, a user has access to the fixed magazine 34 in order to load ammunition into the firearm 10. The firearm 10 further includes a latch 38 mounted on one of the upper or lower receivers 12 and 20. In this example, latch 38 is mounted on the lower receiver 20 in spaced relation away from the pivot axis 22.

Figure 3:
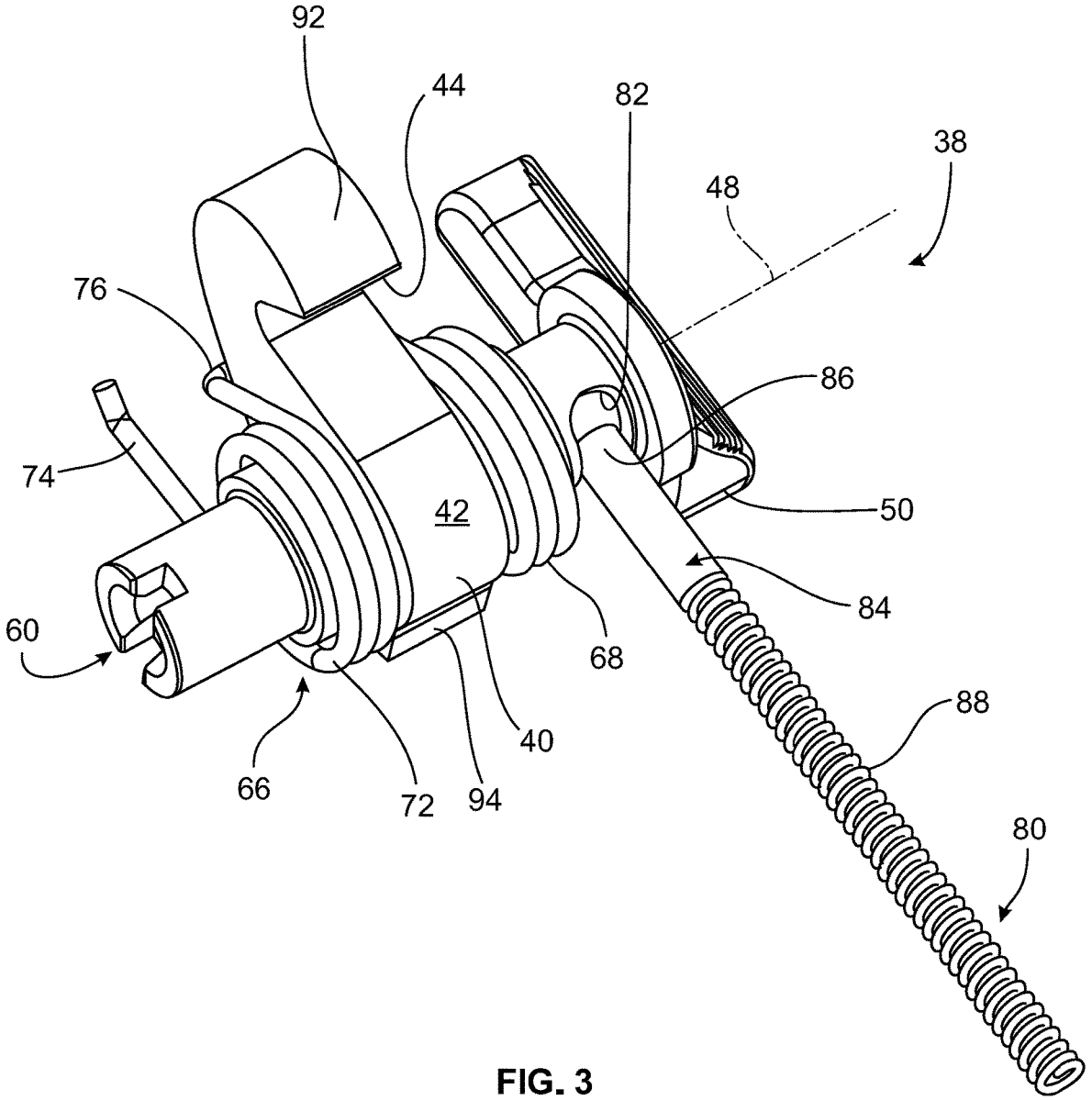
FIG. 3 is an isometric view of an example latch according to the disclosure.
Figure 4:
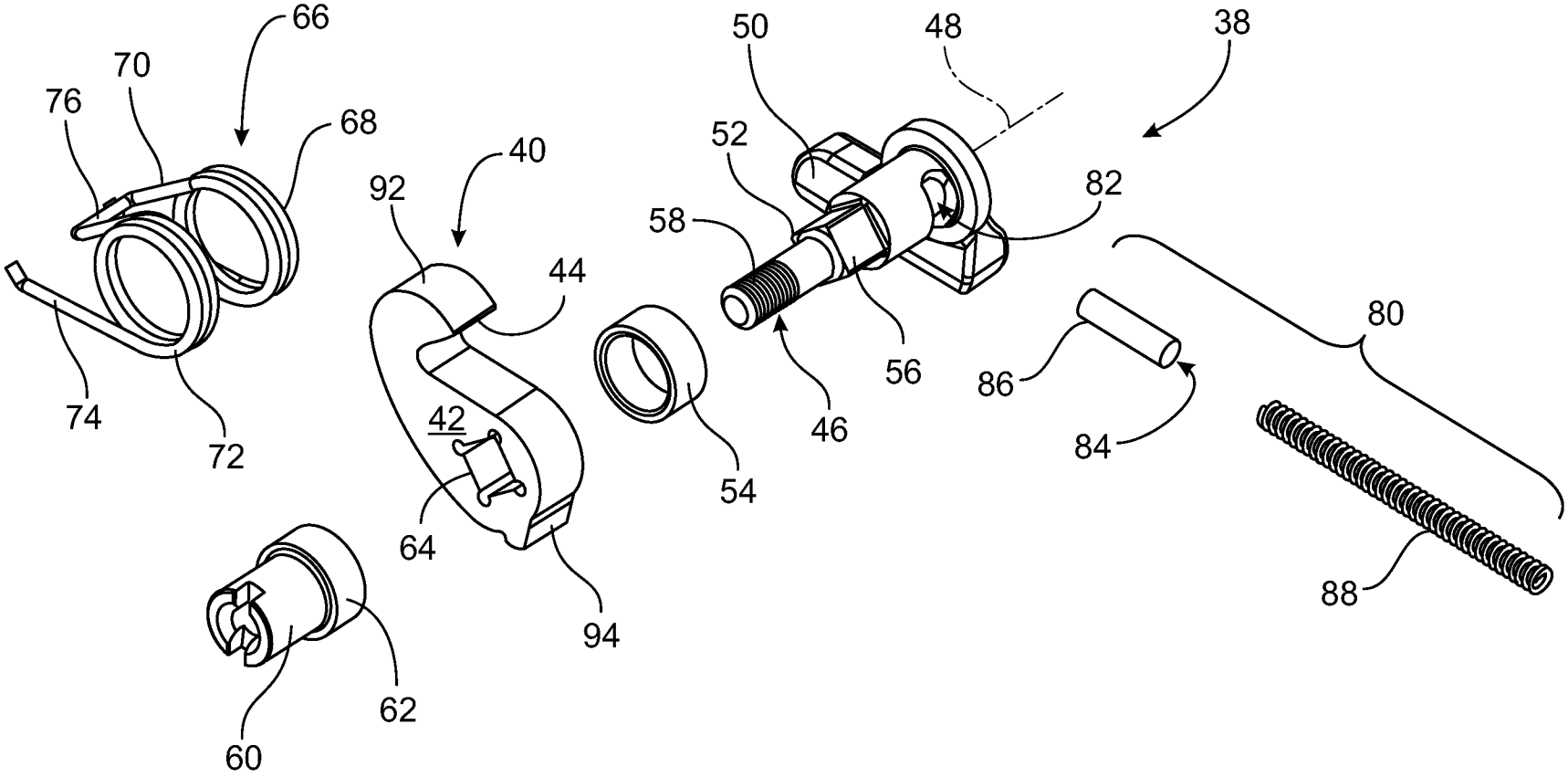
FIG. 4 is an isometric exploded view of the latch shown in FIG. 3.
Figure 5:
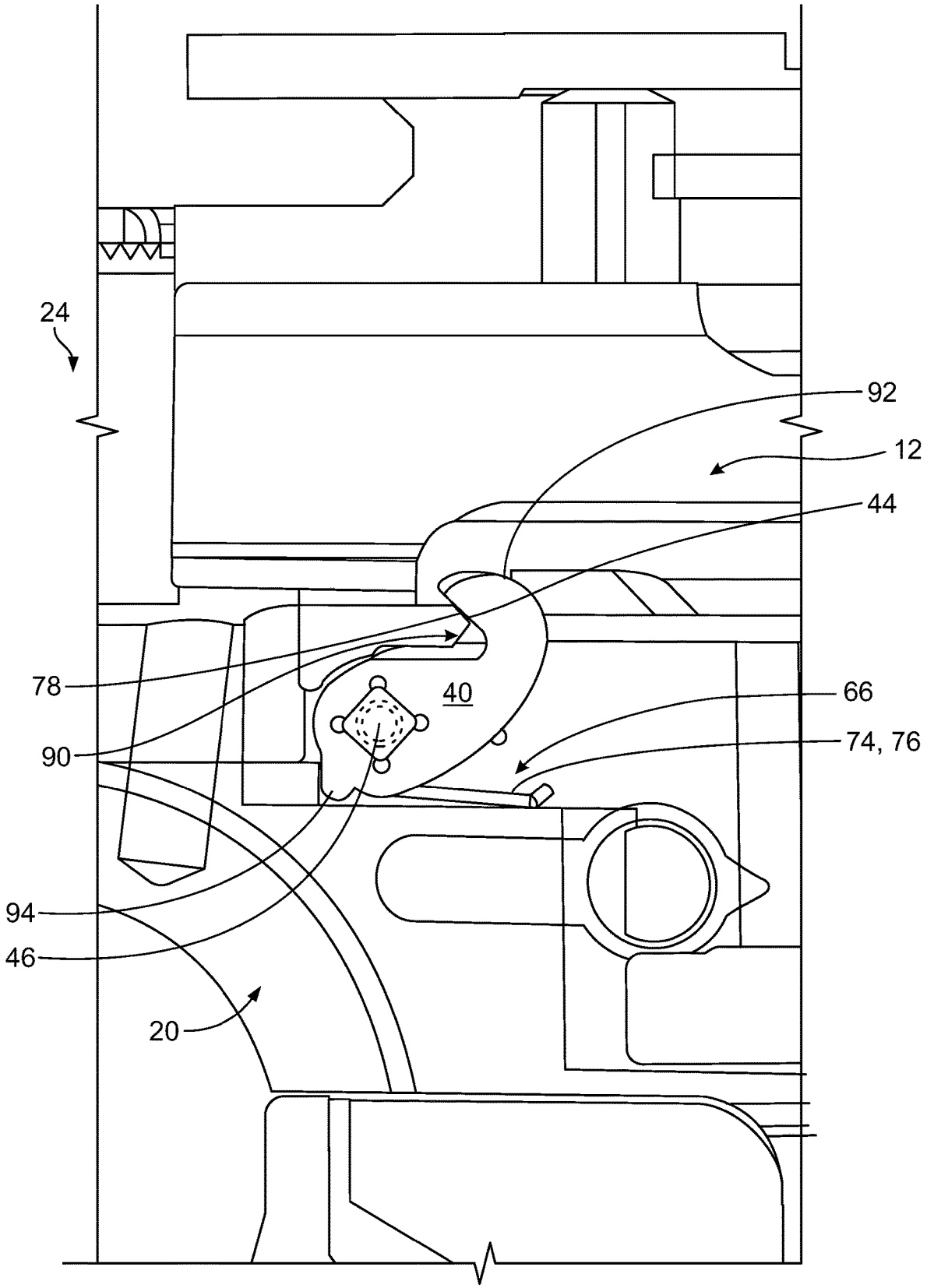
FIG. 5 is a partial sectional view showing the upper and lower receivers held in the closed position by the latch shown in FIG. 3.

Referring now to FIGS. 3 and 4, which depict the example latch 38. The latch 38 is depicted mounted on the lower receiver 20 with complementary engaging structure (as defined below) mounted within the upper receiver 12 (FIGS. 1,2 and 5). It is contemplated, however, that the latch 38 could be mounted on the upper receiver 12 and with complementary engaging structure mounted on the lower receiver 20. The latch 38 includes a hook 40 having a body 42 defining a contact surface 44. The hook 40 is mounted on an axle 46 which defines a longitudinal axis 48 oriented transversely to the firing axis 18 (see FIG. 1). The axle 46 is rotatable relatively to the lower receiver 20 about the longitudinal axis 48. A lever 50 is attached to the axle 46 to permit manual rotation of the axle.

The axle 46, in one example, includes a shaft 52 having a first spring retention cylinder 54, a non-circular geometric portion 56, and a shaft threaded portion 58. The axle 46 further includes a retaining nut 60 configured to engage the shaft threaded portion 58 and a second spring retention cylinder 62. The body 42 may include a non-circular geometric bore 64 configured to engage the non-circular geometric portion 56 such that the body 42 rotates in concert with the axle 46. When the latch 38 is assembled, as shown in FIG. 3. The first spring retention cylinder 54 and the second spring retention cylinder 62 are positioned on opposing sides of the body 42. In at least one embodiment, the first spring retention cylinder 54 and the second spring retention cylinder 62 are bearing sleeves. In another contemplated embodiment the first spring retention cylinder 54 is affixed to the shaft 52 or is formed as a unifying portion of the shaft 52. Similarly, it is contemplated that the second spring retention cylinder 62 may be affixed to the retaining nut 60 or formed as a unifying portion of the retaining nut 60.

The latch 38 includes a hook spring 66 mounted to the axle 46 and biasing the body 42. In one particular example, the hook spring 66 includes a first spring coil 68, a first pressure arm 70, a second spring coil 72, a second pressure arm 74 and a horizontal spacing arm 76. When the hook spring 66 is mounted to the axle 46 as shown in FIG. 3, the first spring coil 68 engages the first spring retention cylinder 54, the second spring coil 72 engages the second spring retention cylinder 62, the horizontal spacing arm 76 engages the body 42, and the first and second pressure arms 70,74 engage one of the upper receiver 12 or the lower receiver 20 (as shown in FIG. 5).

Figure 6:
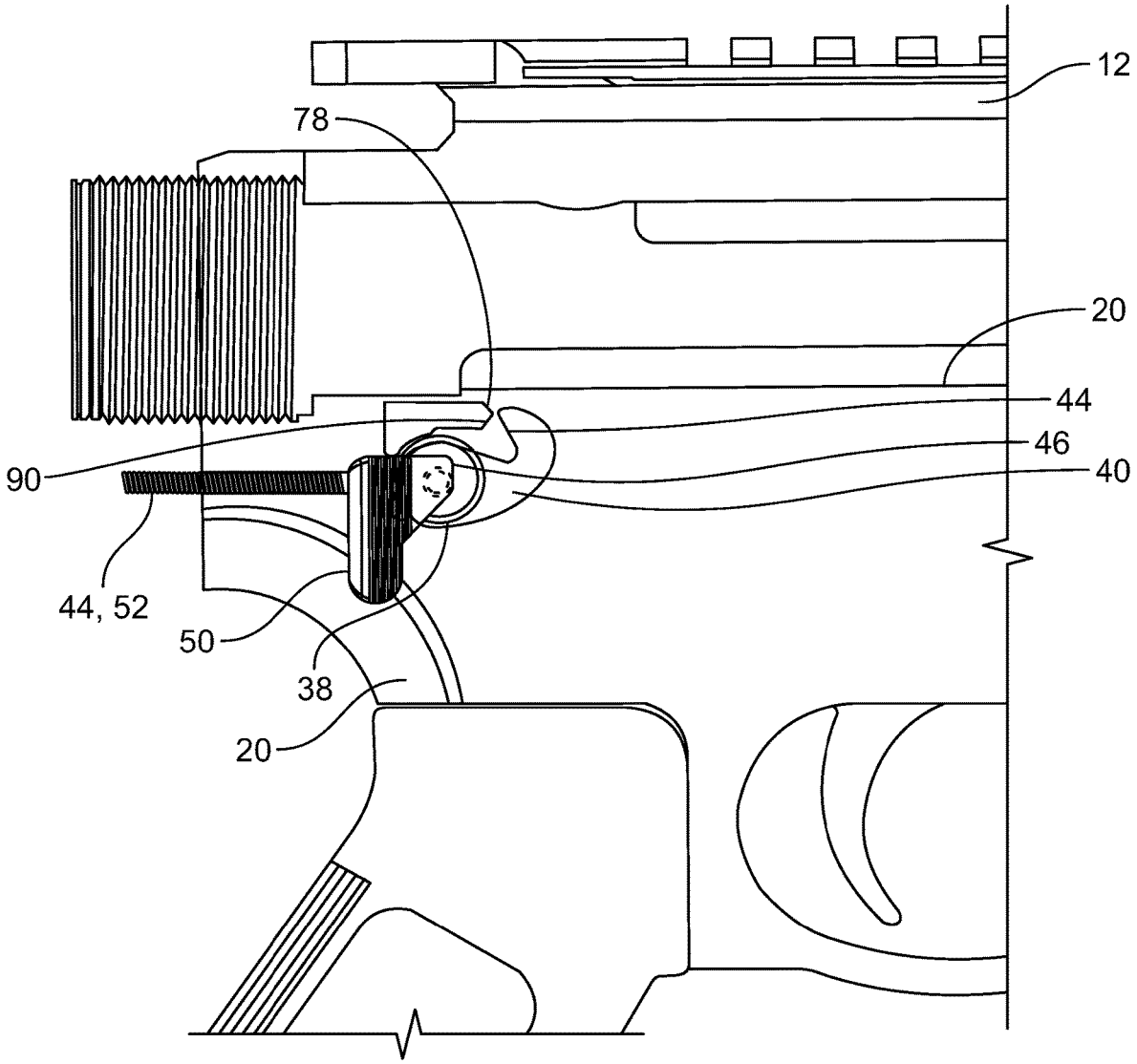
FIG. 6 is a partial transparent view of a portion of the example latch and the example upper and lower receivers according to the disclosure.

Referring now to FIG. 5, a hook receiving surface 78 is positioned (in this example) on the upper receiver 12 adjacent to the hook 40. (Hook receiving surface 78 would be positioned on the lower receiver 20 if the latch 38 were mounted on the upper receiver 12). When the upper and lower receivers 12 and 20 are in the closed position 24 as shown, the hook's contact surface 44 engages the hook receiving surface 78 to lock the upper and lower receivers in the closed position. The hook spring 66 biases the contact surface 44 towards the hook receiving surface 78. As shown in FIG. 6, upon rotation of the axle 46 (clockwise in this view) via the lever 50, the contact surface 44 disengages from the hook receiving surface 78 to permit pivoting of the upper and lower receivers 12 and 20 between the closed 24 and open positions 26 of FIGS. 1 and 2.

In one example, the firearm 10 may further include a detent 80 positioned in one of the upper receiver 12 or the lower receiver 20 and engaging the axle 46 (see FIGS. 3, 4, and 6). The detent 80 is inserted in one of the receivers 12,20 and engages a partially-circumferential trough 82 formed in the shaft 52 of the axle 46. In one embodiment, the detent 80 comprises a plunger 84 slidably mounted within one of the upper or lower receivers 12,20. The plunger 84 includes a head 86 engaging the partially-circumferential trough 82 (see FIG. 3). The plunger 84 further includes a plunger spring 88 acting between the receiver (12,20), where the detent 80 is mounted, and the plunger 84 to bias the plunger 84 and head 86 towards the partially-circumferential trough 82. The detent 80, when installed, prevents removal of the axle 46 from the receiver 12,20 in which it is installed. Additionally, the partially-circumferential trough 82, when engaged by the detent 80, stops the biased rotation of the hook 40 when the receivers 12, 20 are in the open position 26. This allows the contact surface 44 of the hook 40 to be positioned to engage the hook receiving surface 78 when the receivers 12, 20 are moved from the open position 26 to the closed position 24 without manual adjustment of the lever 50.

Figure 7:
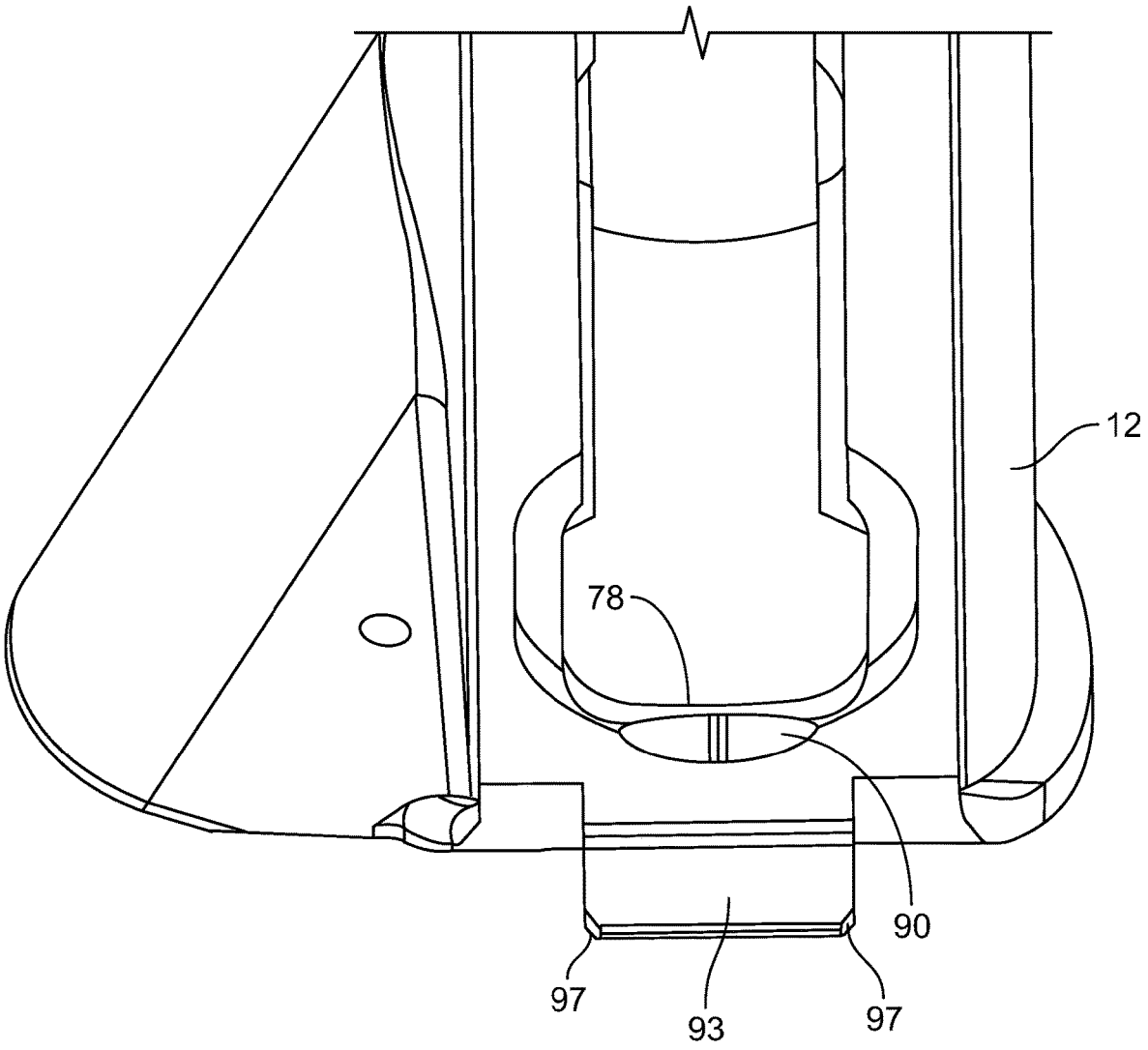
FIG. 7 is an isometric view of a portion of the upper receiver shown in FIG. 5.
Figure 8:
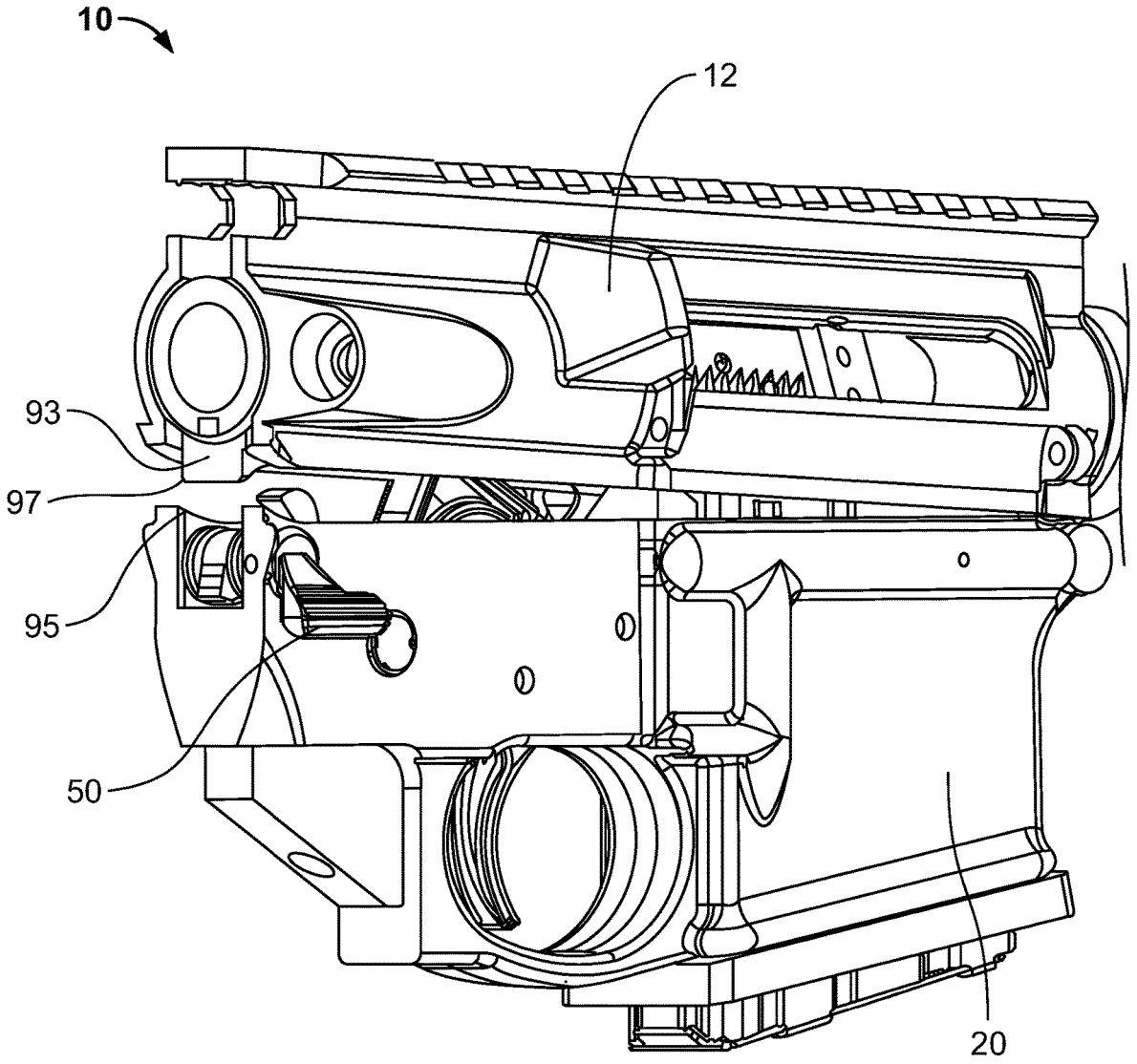
FIG. 8 is an isometric view of a portion of the upper receiver and lower receiver shown in FIG. 5.

In one example, the firearm 10 may further include a cam 90 formed on one of the upper or lower receivers 12, 20 in facing relation with the hook 40. The cam 90 is positioned opposite and angled away from the hook receiving surface 78 (see FIGS. 5-7). In one particular embodiment, the cam 90 comprises a concave counter surface as shown in FIG. 7. The concave counter surface 90 centers about the hook 40 when the receivers 12, 20 are moved from the open position 26 to the closed position 24 to provide a smooth and reliable engagement of the hook 40 to the hook receiving surface 78. It should be understood that the cam 90 may comprise other angled surfaces configured to engage the hook 40. The body 42 of the hook 40 also may include a cam follower 92. In at least one embodiment, the cam follower 92 comprises a curved surface of the body 42. The firearm may further include a boss 93 formed on one of the upper or lower receiver 12, 20 and a boss guide 95 formed in the other of the upper and lower receiver 12, 20 (see FIGS. 7 and 8). The boss 93 and boss guide 95 locate and align the upper and lower receivers 12, 20 when they are moved from the open position 26 to the close position 24. In one example, the boss 93 includes chamfered corners 97 to further assist in alignment of the upper and lower receivers 12, 20 when they are moved from the open position 26 to the close position 24.

Figure 9:
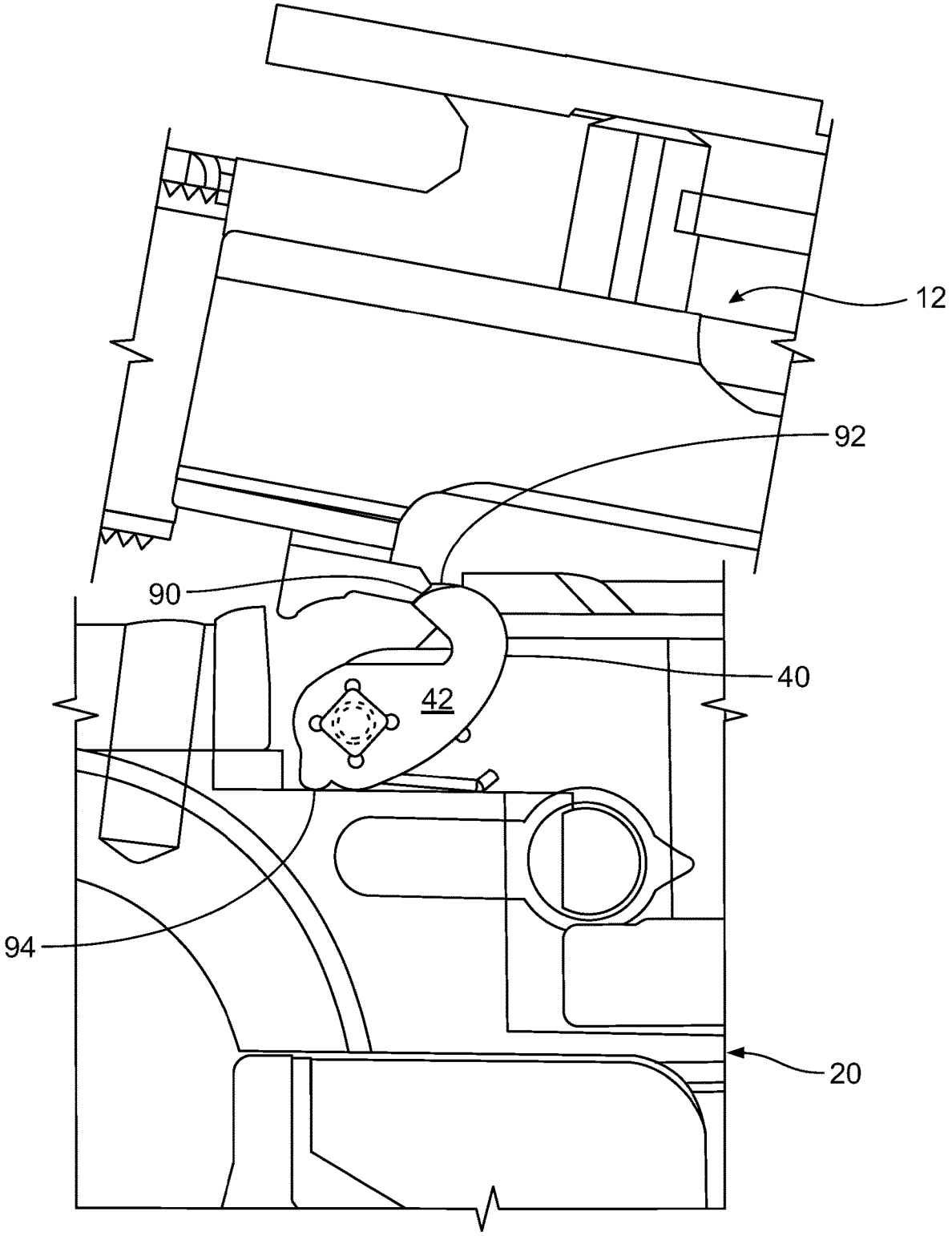
FIG. 9 is a partial sectional view of the upper and lower receivers moving from an open position to a closed position, the view illustrating the cam contacting the cam follower.
Figure 10:
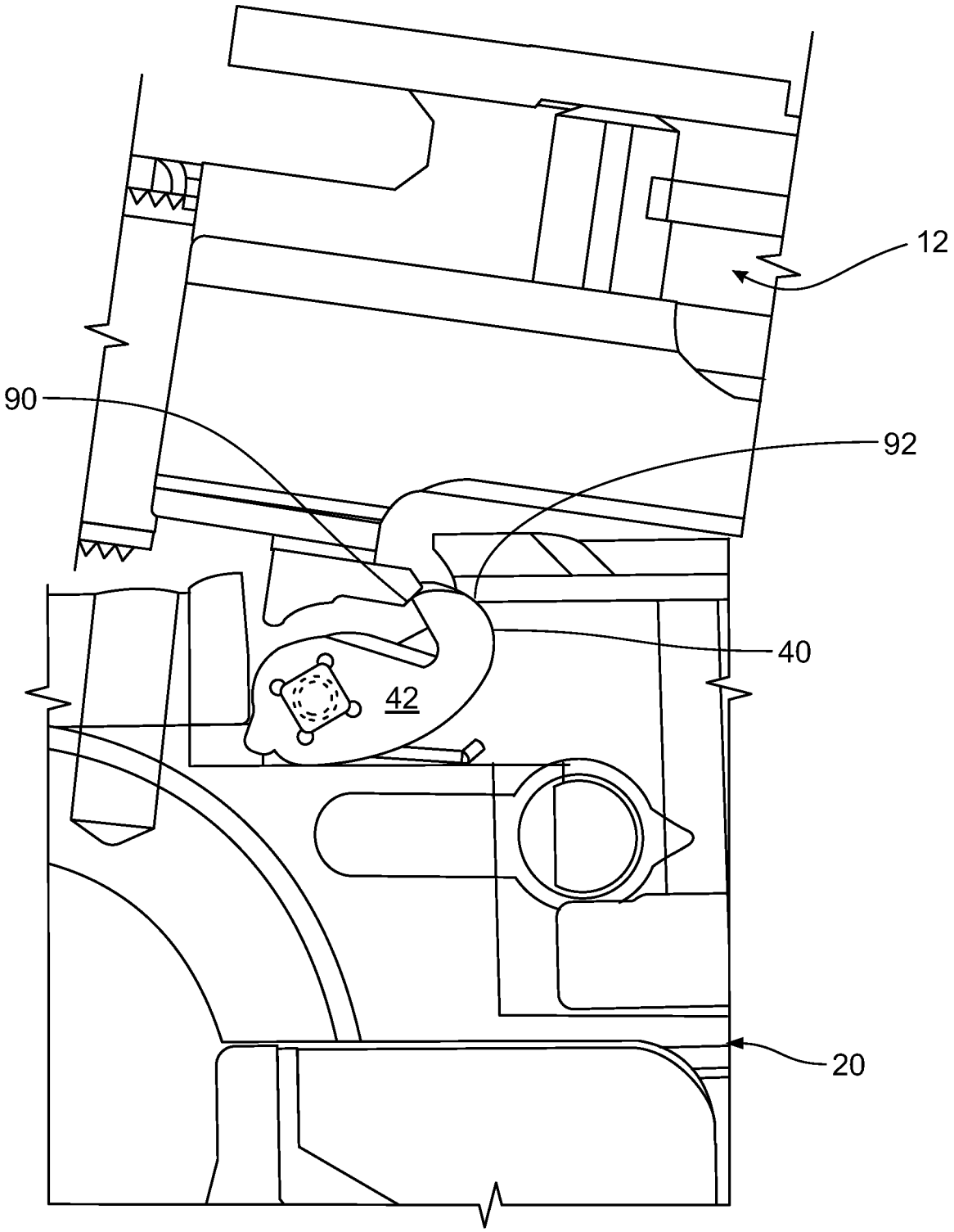
FIG. 10 is a partial sectional view of the upper and lower receivers moving from an open position to a closed position, the view illustrating the cam moving the cam follower to rotate the latch.
Figure 11:
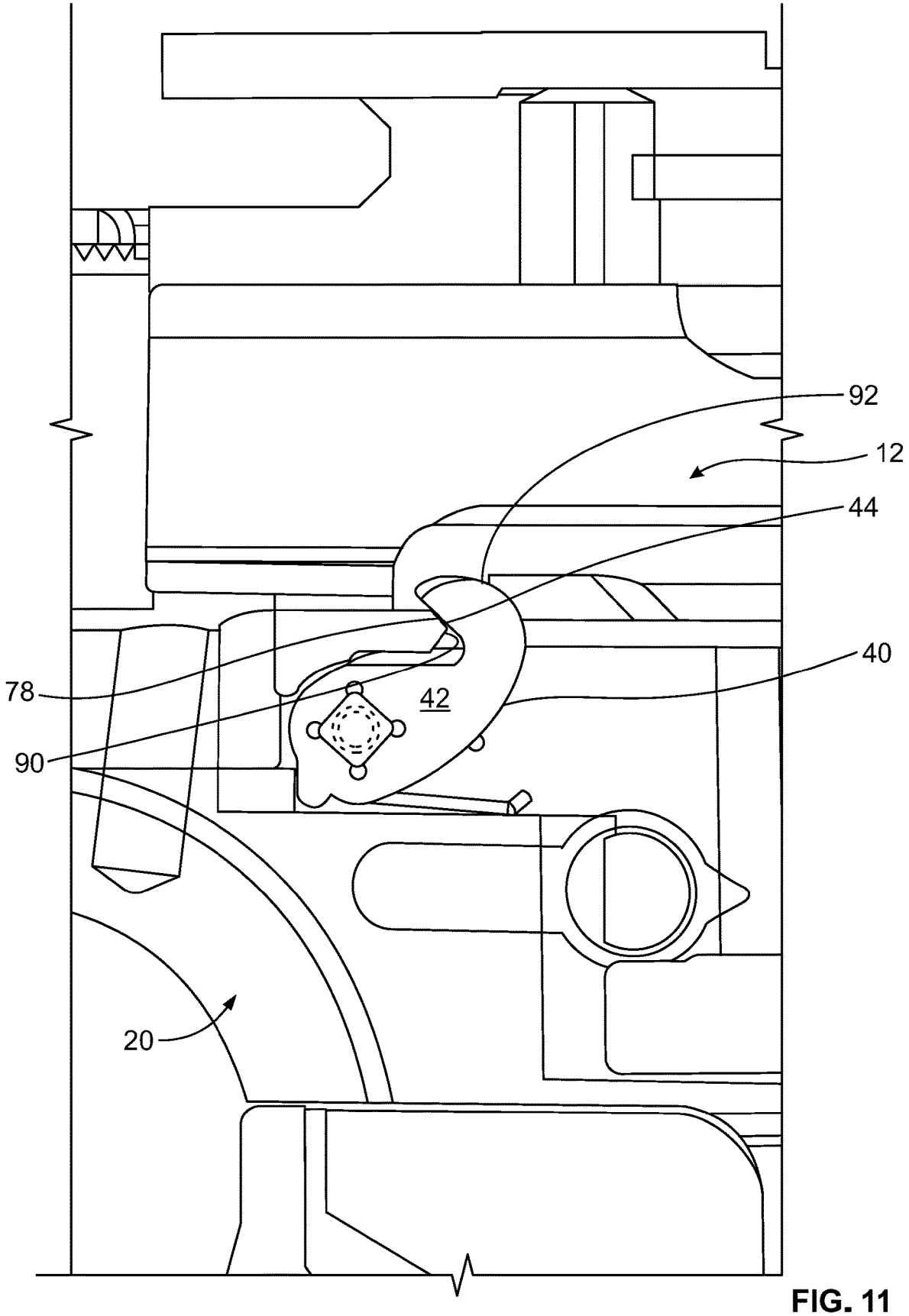
FIG. 11 is a partial sectional view of the upper and lower receivers moving to the closed position, the view illustrating the contact surface moving into alignment with the hook receiving surface.

Referring now to FIGS. 9-11 which depict the interaction between the cam 90 and the cam follower 92 when the firearm 10 is moved from the open position 26 to the closed position 24. As the upper receiver 12 is rotated towards the lower receiver 20, the cam 90 comes into contact with the cam follower 92 (see FIG. 9). The cam 90 forces the rotation of the hook 40 against the bias of the hook spring 66 (FIG. 10). When hook 40 rotates sufficiently the contact surface 44 is free to engage the hook receiving surface 78 and the hook spring 66 moves the body 42 such that the contact surface 44 rotates into engagement with the hook receiving surface 78 (FIG. 11).

The body 42 of the hook 40 may additionally include a protrusion 94 formed as a portion thereof. The protrusion 94 engages the receiver 12, 20, wherein the latch is mounted, to limit rotation of the body 42 due to the bias of the hook spring 66. The protrusion 94 stops rotation of the body 42 in a position where the cam follower 92 is placed to engage the cam 90 when the receiver 12, 20 are moved from the open position 26 to the closed position 24. The protrusion 94 acts in concert with the partially-circumferential trough 82 to position the hook 40 for engagement with the receiver 12,20 when moved into the closed position 24. In addition the protrusion 94 and partially-circumferential trough 82 act in concert to distribute forces on the firearm 10 when the upper receiver 12 is separated from the lower receiver 20 and the hook spring 66 moves the hook 40 into its biased position.

Firearms 10 having fixed (as opposed to detachable) magazine 34 are expected to realize significant operational advantages when latches 38 according to the disclosure are incorporated. As shown in FIG. 2, access to the magazine 34 is readily provided by manipulating the lever 50 to disengage the hook's contact surface 44 from the hook receiving surface 78, thereby permitting the upper and lower receivers to be pivoted into the open position for loading of ammunition 96 into the magazine 34. Examples of firearms having fixed magazines are disclosed in U.S. Pat. No. 9,341,421, which patent is hereby incorporated by reference herein. All patent applications, patents, and printed publications cited herein are incorporated herein by reference in the entireties, except for any definitions, subject matter disclaimers or disavowals, and except to the extent that the incorporated material is inconsistent with the express disclosure herein, in which case the language in this disclosure controls.

What is claimed is:

1. A firearm comprising:

an upper receiver;

a barrel mounted on said upper receiver, said barrel having a bore defining a firing axis coaxially arranged therewith;

a lower receiver attached to said upper receiver, said lower and upper receivers pivotable relative to one another about a pivot axis oriented transversely to said firing axis between a closed position and an open position;

a latch mounted on one of said upper or lower receivers in spaced relation away from said pivot axis, said latch comprising:

a hook having a body defining a contact surface;

an axle defining a longitudinal axis oriented transversely to said firing axis, said axle being rotatable about said longitudinal axis, said hook being mounted on said axle;

a lever attached to said axle for manual rotation of said axle;

a hook receiving surface positioned on one of said upper or lower receivers adjacent to said hook such that, when said upper and lower receivers are in said closed position, said contact surface is engageable with and disengageable from said hook receiving surface upon rotation of said axle; and a hook spring mounted to said axle and in contact with said body, said hook spring biasing said contact surface towards said hook receiving surface.

2. The firearm according to claim 1, wherein said latch is mounted on said lower receiver and said hook receiving surface is positioned on said upper receiver.

3. The firearm according to claim 1, wherein said axle further comprises:

a shaft;

a first spring retention cylinder attached to said shaft;

a retaining nut; and a second spring retention cylinder attached to said retaining nut;

wherein when said latch is assembled said first spring retention cylinder and said second spring retention cylinder are positioned on opposed sides of said body.

4. The firearm according to claim 3, wherein said hook spring comprises:

a first spring coil including a first pressure arm extending therefrom;

a second spring coil including a second pressure arm extending therefrom; and a horizontal spacing arm connecting said first spring coil and said second spring coil;

wherein when said hook spring is mounted on said axle said first spring coil engages said first spring retention cylinder, said second spring coil engages said second spring retention cylinder, said horizontal spacing arm engages said body, and said first and second pressure arms engage one of said upper receiver or said lower receiver.

5. The firearm according to claim 1, further comprising:

A boss formed on one of the upper receiver or the lower receiver opposite the pivot axis; and A boss guide formed on one of the upper receiver or the lower receiver opposite the pivot axis facing the boss;

wherein the boss engages the boss guide to align the upper receiver and the lower receiver when the upper receiver and the lower receiver are moved from the open position to the closed position.

6. The firearm according to claim 3, wherein said first spring retention cylinder comprises a bearing sleeve.

7. The firearm according to claim 3, wherein said shaft includes a partially-circumferential trough.

8. The firearm according to claim 7, further comprising:

a detent acting between said axle and one of said upper receiver or said lower receiver, said detent engaging said partially-circumferential trough for retaining said latch within one of said lower receiver or said upper receiver.

9. The firearm according to claim 8, wherein said detent comprises:

a plunger slidably mounted within one of said upper receiver or said lower receiver, said plunger having a head engageable with said partially-circumferential trough; and a plunger spring acting between said lower receiver and said plunger for biasing said plunger toward said partially-circumferential trough.

10. The firearm according to claim 8, wherein said partially-circumferential trough, when engaged by said detent, limits rotation of said axle such that said contact surface engages said hook receiving surface when said upper receiver and said lower receiver are moved into said closed position from said open position.

11. The firearm according to claim 2, further comprising:

a cam positioned on said upper receiver in facing relation with said hook; and a cam follower positioned on said hook in facing relation with said cam, said cam engaging said cam follower and rotating said hook against the bias of said hook spring until said contact surface is clear to engage said hook receiving surface when said upper and lower receivers are pivoted from said open position to said closed position.

12. The firearm according to claim 11, further comprising:

a protrusion formed on said body, said protrusion stopping rotation of said hook by said hook spring in a position wherein said cam follower is positioned to engage said cam.

13. The firearm according to claim 12, wherein said protrusion and said partially-circumferential trough operate in concert to correctly position said cam with said cam follower when said upper and lower receivers are pivoted between said open and said closed positions.

14. A firearm comprising:

an upper receiver;

a lower receiver attached to said upper receiver, said lower and upper receivers being pivotable relative to one another about a pivot axis between a closed position and an open position;

a latch mounted on one of said upper or lower receivers in spaced relation away from said pivot axis, said latch comprising:

a hook having a body defining a contact surface and a cam follower;

an axle defining a longitudinal axis, said axle being rotatable about said longitudinal axis, said hook being mounted on said axle;

a lever attached to said axle for manual rotation of said axle;

a hook receiving surface positioned on one of said upper or lower receivers adjacent to said hook such that when said upper and lower receivers are in said closed position, said contact surface engageable and disengageable from said hook receiving surface upon rotation of said axle;

a cam positioned on one of said upper or lower receivers, said cam positioned opposite said hook receiving surface and angled away from said hook receiving surface; and a hook spring mounted to said axle and in contact with said body, said hook spring biasing said contact surface towards said hook receiving surface;

wherein said cam engages said cam follower and rotates said hook against said hook spring bias until said contact surface is clear to engage said hook receiving surface when said upper and lower receivers are pivoted from said open position to said closed position.

15. The firearm according to claim 14; wherein said cam comprises a concave counter surface and said cam follower comprises a curved surface of said body.

16. The firearm according to claim 14, further comprising:

a plunger slidably mounted within one of said upper receiver or said lower receiver, said plunger having a head engageable with said partially-circumferential trough; and a plunger spring acting between one of said upper receiver or said lower receiver and said plunger spring for biasing said plunger toward said partially-circumferential trough;

wherein said partially-circumferential trough, when engaged by said head, limits rotation of said axle such that said cam follower is in position to engage said cam when said upper receiver and said lower receiver are moved into said closed position from said open position.

17. The firearm according to claim 16, further comprising:

a protrusion formed on said body, said protrusion stopping said hook spring biased rotation of said hook in an engagement position wherein said cam follower is positioned to engage said cam;

wherein said partially-circumferential trough and said protrusion act in concert to position said body when said lower receiver and said upper receiver are in said open position.

18. A method of selectively locking and unlocking a firearm comprised of a upper receiver and a lower receiver pivotable relative to each other about a pivot bearing between a closed position and an open position, the method comprising:

positioning a latch within one of said upper receiver or said lower receiver, said latch comprising a lever attached to an axle and a hook having a body defining a contact surface and a cam follower, said body affixed to said axle;

positioning a cam and a hook receiving surface on one of said upper or lower receivers, said cam positioned opposite said hook receiving surface and angled away from said hook receiving surface;

biasing said contact surface towards said hook receiving surface utilizing a hook spring;

wherein said cam engages said cam follower and rotates said hook against said hook spring bias until said contact surface is clear to engage said hook receiving surface when said upper and lower receivers are pivoted from said open position to said closed position; and wherein said contact surface is engageable with and disengageable from said hook receiving surface upon rotation of said lever.

19. The method according to claim 18, further comprising:

providing a protrusion on said body to limit biased movement of said contact surface.

20. The method according to claim 18, further comprising:

providing a partially-circumferential trough on said axle; and providing a detent within said partially-circumferential trough to limit biased movement of said contact surface and prevent removal of said axle.

* * * * *